United States Patent [19]

Sheetz et al.

[11] Patent Number: 4,535,212

[45] Date of Patent: Aug. 13, 1985

[54] APPARATUS AND METHOD OF HARDENING VALVE SEATS

[75] Inventors: Richard S. Sheetz, Shaker Hts.; John F. Cachat, Rocky River, both of Ohio

[73] Assignee: Tocco, Inc., Boaz, Ala.

[21] Appl. No.: 628,394

[22] Filed: Jul. 6, 1984

[51] Int. Cl.[3] ..... H05B 6/06

[52] U.S. Cl. ..... 219/10.77; 219/10.57; 219/10.43

[58] Field of Search ..... 219/10.57, 10.77, 10.79, 219/10.43, 10.41, 10.73, 121 LX, 121 LY, 121 EC, 121 EX, 121 ED; 318/576

[56] References Cited

U.S. PATENT DOCUMENTS

| | | | |
|---|---|---|---|
| Re. 29,046 | 11/1976 | Delpaggio | 219/10.57 |
| 2,828,397 | 3/1958 | Emerson | 219/10.43 |
| 3,109,909 | 11/1963 | McBrien | 219/10.79 |
| 3,648,009 | 3/1972 | Steigerwald | 219/121 ED |
| 3,686,459 | 8/1972 | Lewis | 219/10.57 |
| 3,696,224 | 10/1972 | Lewis | 219/10.57 |
| 3,716,690 | 2/1973 | Bryant | 219/10.77 |
| 3,737,612 | 6/1973 | Pfaffmann et al. | 219/10.79 |
| 3,743,776 | 7/1973 | Corcelle et al. | 219/121 EC |
| 3,743,809 | 7/1973 | Delpaggio | 219/10.57 |
| 3,761,669 | 9/1973 | Delpaggio | 219/10.57 |
| 3,777,096 | 11/1973 | Delpaggio | 219/10.57 |
| 3,789,180 | 1/1974 | Cachat | 219/10.57 |
| 3,837,934 | 9/1974 | Pfaffmann et al. | 148/146 |
| 4,266,109 | 5/1981 | Ciolkevich | 219/10.57 |
| 4,326,155 | 4/1982 | Griebeler | 318/576 |
| 4,459,526 | 7/1984 | Griebeler | 318/576 |

*Primary Examiner*—Roy N. Envall, Jr.
*Assistant Examiner*—M. M. Lateef
*Attorney, Agent, or Firm*—Body, Vickers & Daniels

[57] ABSTRACT

A method and apparatus for inductively heating valve seats wherein an inductor is driven to a predetermined magnetic coupling with the valve seat under the control a range detecting transceiver unit.

9 Claims, 9 Drawing Figures

FIG. 5
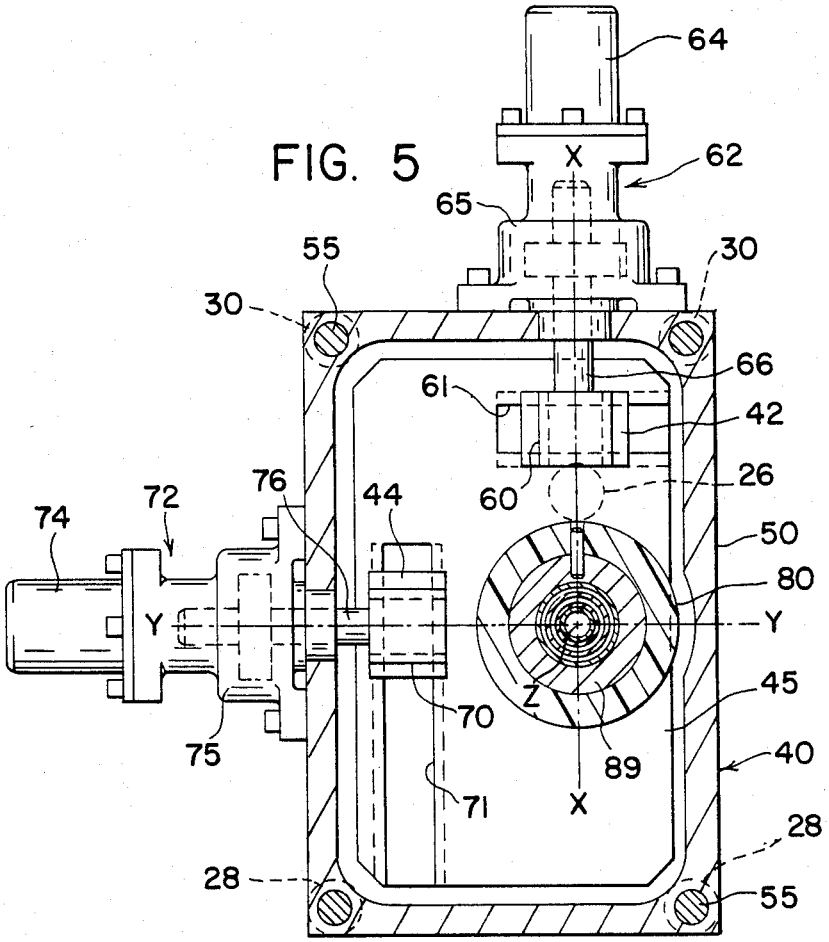
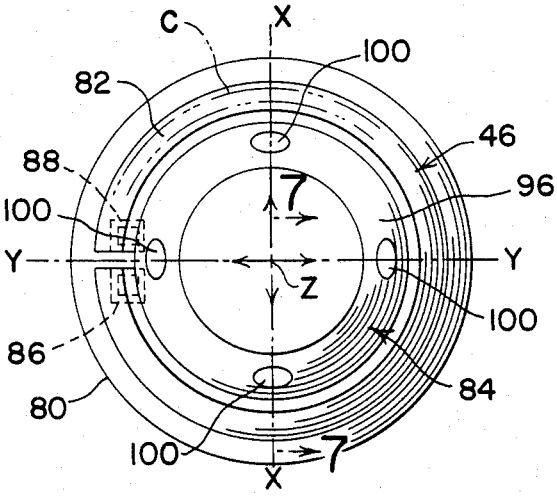
FIG. 6

APPARATUS AND METHOD OF HARDENING VALVE SEATS

The present invention relates to the art of heat treating, and in particular, to a method and apparatus for inductively heating the valve seats of an engine component, such as an engine head.

BACKGROUND

The invention is particularly applicable for inductively heating the exhaust valve seats or valve seat inserts of internal combustion engines and will be described with reference thereto; however, the invention, in its broader application, may be used in other heat treating applications wherein accurate positioning of a heating device is required to assure uniform heating of and properties for the surface to be treated.

To provide the required extended wear characteristics for the poppet valve-valve seat interface, it has become commonplace to quench harden the generally conical valve seat area. The necessary hardened surface for extended wear can be provided by accurately locating an inductor coil adjacent the seat, energizing the coil with a high frequency current to raise the temperature to the desired temperature, followed by rapid quenching.

To achieve the required heating uniformity and temperature control, it is necessary that the inductor be accurately located with respect to the conical valve surface, with an inductive air gap in the order of 0.030 to 0.050 inches. This accuracy is difficult to attain in mass production unless the inductor positioning apparatus can account and compensate for the manufacturing variations in the radial and axial location of the valve seat.

Various approaches have been taken to provide the required inductor positioning accuracy. U.S. Pat. No. Re. 29,046, illustrates a machine wherein the individual inductor assemblies are allowed to radially float with respect to the valve seat as they axially approach the valve seat area. The inductor assemblies carry a centering nose which enters a valve bore coaxial with the valve seat. This radially locates the inductor coaxial with the valve seat, notwithstanding manufacturing variances in the location of the valve axis. Other approaches for achieving this radial alignment feature are illustrated in U.S. Pat. Nos. 4,266,109; 3,837,934; 3,777,096; 3,761,669; 3,743,809 and 3,737,612. Having achieved concentric coaxial alignment with the valve seat, it is also necessary to accurately establish the axial location of the inductor with respect to the valve seat inasmuch as this dimension can vary from valve to valve and engine to engine. This correct positioning must be attained to establish the required inductive air gap to optimumly heat at a controlled temperature, and with regard to the simultaneous heating of multiple valve seats, an inductive current balance among the various inductors.

One successful approach, as illustrated in the aforementioned U.S. Pat. No. Re. 29,046, has been to individually seat the concentrically located inductor with the valve seat against a spring bias, axially lock the inductor to its frame and then axially withdraw the inductor a predetermined axial distance corresponding to the desired inductive gap. This repetitively provides accurate inductor positioning notwithstanding axial and/or radial variation in the location of the valve seat surface.

BRIEF SUMMARY OF THE INVENTION

The present invention provides a method and apparatus for individually axially and radially positioning the inductors with respect to the valve seat, without directly contacting the seat during the movement of the inductor toward the valve seat.

In accordance with the present invention, range detecting transceiver units are carried with the inductor. The transceiver units reflect off the conical valve seat surface as the inductor is axially moved toward the heating position. The transceivers are coupled to axial and radial drive motors through a comparator or micropressor. The comparator translates the reflected signals corresponding to the relative spacial position of the inductor with respect to the valve seat. The drive motors are operative between the frame and the coil to effect controlled movement to the inductor until concentricity of the inductor with the valve seat, at the predetermined gap, is achieved.

In another aspect of the present invention, there is provided a method of positioning a conical inductor in predetermined inductive heating position with respect to a valve seat using range detecting transceivers by reflecting energy off the valve seat while radially centering and axially moving the inductor toward the valve seat, receiving the reflected energy and continuing axial movement of the inductor toward the valve seat until the reflected energy corresponds to a predetermined diametral relationship between the transceiver and the valve seat, comparing the axial position of the transceivers to the axial position of a predetermined diametral relationship on the inductor and further continuing the axial movement in accordance therewith until the inductor bears the predetermined inductive heating position with respect to the valve seat.

Accordingly, it is an object of the present invention to provide a method and apparatus for individually concentrically locating heating devices in proper heating relationships with associated parts.

Another object of the present invention is to provide a method and apparatus for radially and axially aligning an inductor moving toward a valve seat until a predetermined inductive coupling is achieved.

A further object of the present invention is to use reflective energy from a valve seat surface to provide signals indicative of the axial and radial positions of an inductor relative to the valve seat and to energize positioning devices for moving the inductor to a predetermined spacial relationship between the inductor and the valve seat surface.

Other objects and advantages will become apparent to those skilled in the art upon reading the detailed description in conjunction with the following drawings.

BRIEF DESCRIPTION OF THE DRAWINGS

FIG. 5 is a sectional view taken along line 5—5 of FIG. 3;

FIG. 6 is a sectional view taken along line 6—6 of FIG. 3;

DETAILED DESCRIPTION OF THE PREFERRED EMBODIMENT

Figure 1:
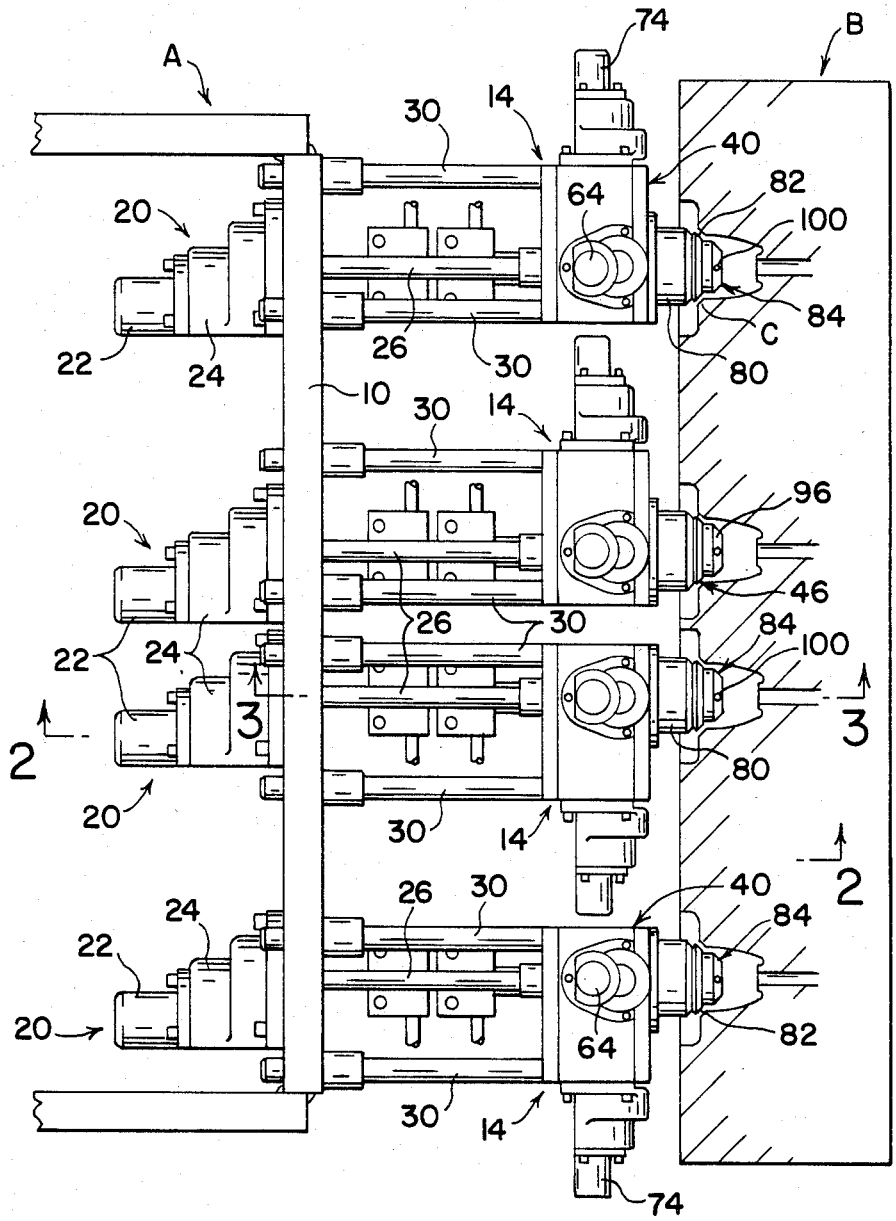
FIG. 1 is a schematic top elevational view illustrating the general environment of the present invention when applied to a machine for inductively heating a series of spaced valve seats in an engine component.
Figure 2A:
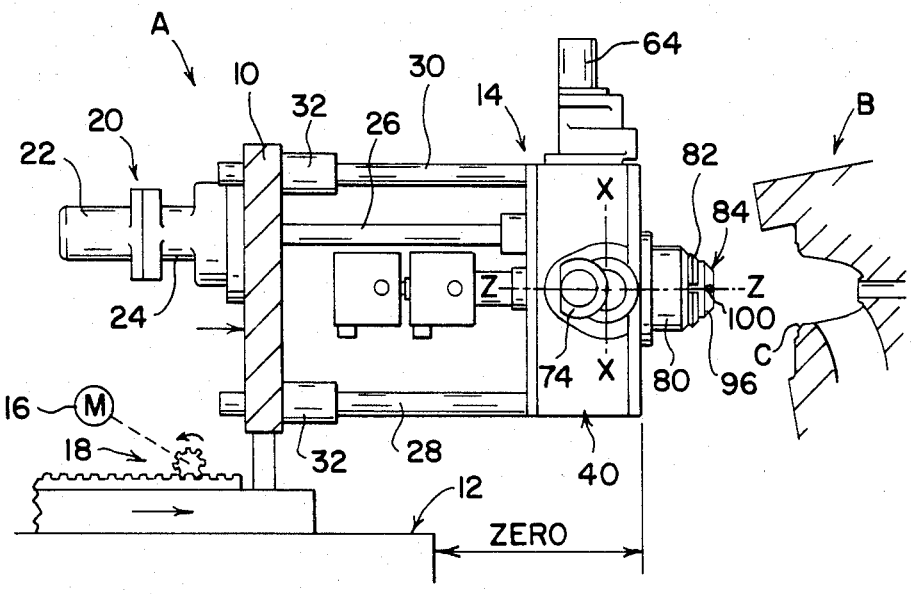
FIGS. 2*a* and 2*b* are enlarged side elevational views showing somewhat schematically the inductor assembly in the three operative positions with reference to the engine components taken along line 2—2 of FIG. 1.

Referring now to the Figures wherein the showings are for the purpose of illustrating a preferred embodiment only, and not for the purpose of limiting same, FIGS. 1 and 2 show a machine or apparatus A which coacts with an engine component B supported opposite thereto for inductively heating the generally conical valve seats C of the engine component. Inasmuch as the present invention relates to an improvement in the general apparatus described in U.S. Pat No. Re. 29,046, which patent is incorporated by reference herein, the machine or apparatus A will be described only briefly.

Figure 2B:
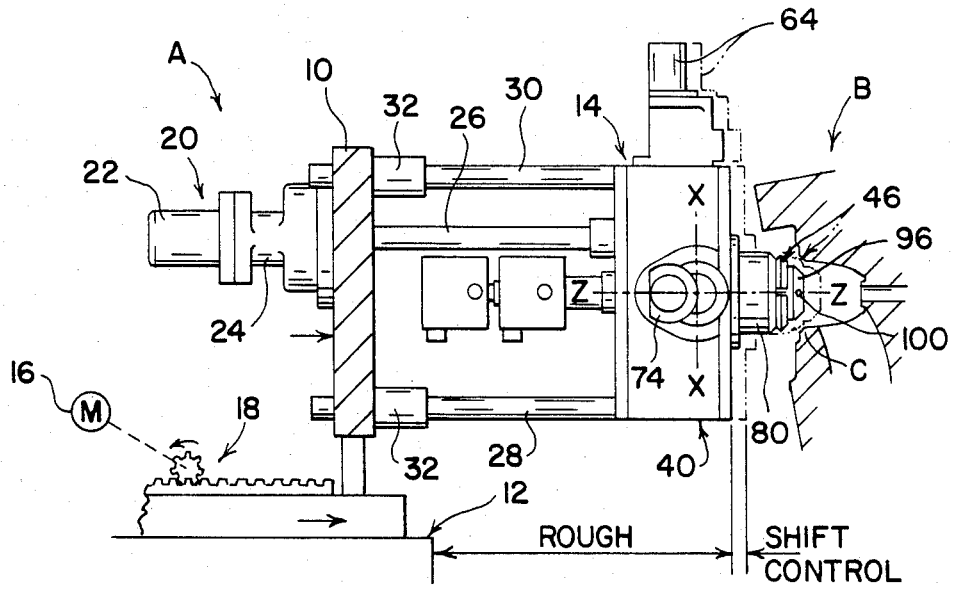
Figure 3:
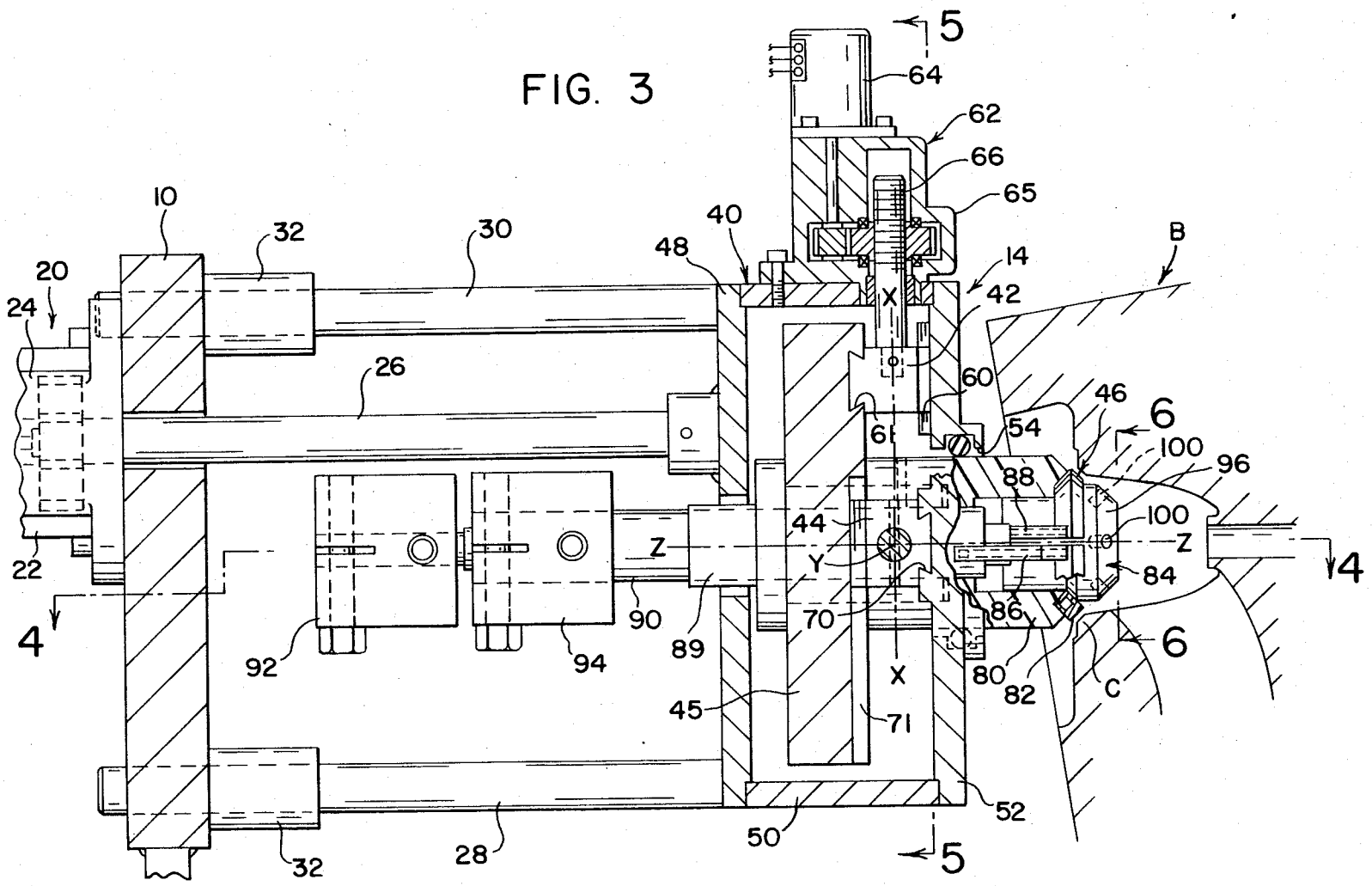
FIG. 3 is an enlarged sectional view of the inductor assembly taken along line 3—3 of FIG. 1.

This apparatus includes a frame 10 movable with respect to a base 12. The frame 10 carries a plurality of inductor assemblies 14. The assemblies 14 move in unison with the frame 10 as it is reciprocated between a zero or a loading position (FIG. 2*a*) and a rough alignment position (FIG. 2*b*). The frame 10 is driven to the rough alignment position by drive motor 16 and rack and pinion unit 18. Thereafter, the assemblies 14 move independently of one another, either sequentially or simultaneously, to heating positions whereat a predetermined spacial relationship exists between the assembly 14 and the valve seats (FIG. 3). As hereinafter explained in detail, this concentrically positions the inductor coil with respect to the valve seat to establish the proper inductive coupling for heating the valve seat to the desired elevated temperature prior to quenching to thereby provide a uniformly hardened valve seat surface.

Four assemblies are shown in FIG. 1 for heating the oppositely disposed valve seats. However, it will be appreciated that the number of assemblies can be appropriately increased or decreased as required by the number of valve seats on the engine component.

The valve seats C have axes which, as illustrated, are mutually parallel and disposed perpendicular to the frame 10. The axes may also bear mutually inclined relationships. In any event, the relative angular relationships between the axes are accurately controlled. However, due to manufacturing tolerances, the individual spacial locations of the valve seats may be variably located in the X-Y plane parallel to the frame and along a Z axis perpendicular to the frame 10. As hereinafter described, the inductor assemblies 14 accommodate these variances to accurately concentrically position the inductor with respect to the valve seat.

Variable positioning along the Z axis is provided by drive unit 20. The drive unit 20 comprises a drive motor 22 and a drive actuator 24 which are fixedly mounted on the rear surface of the frame 10. In a conventional manner, by means of internal gearing, the actuator 24 translates rotation of the motor 22 into controlled telescopic axial movement of a drive shaft 26 fixedly connected at its outer end to the assembly 14. Pairs of guide rods 28 and 30 are telescopically supported at their rear portions by bushings 32 on the frame 10 and fixedly connected at their front ends to the assembly 14. The guide rods prescribe telescopic movement of the assemblies along the Z-axis.

Figure 4:
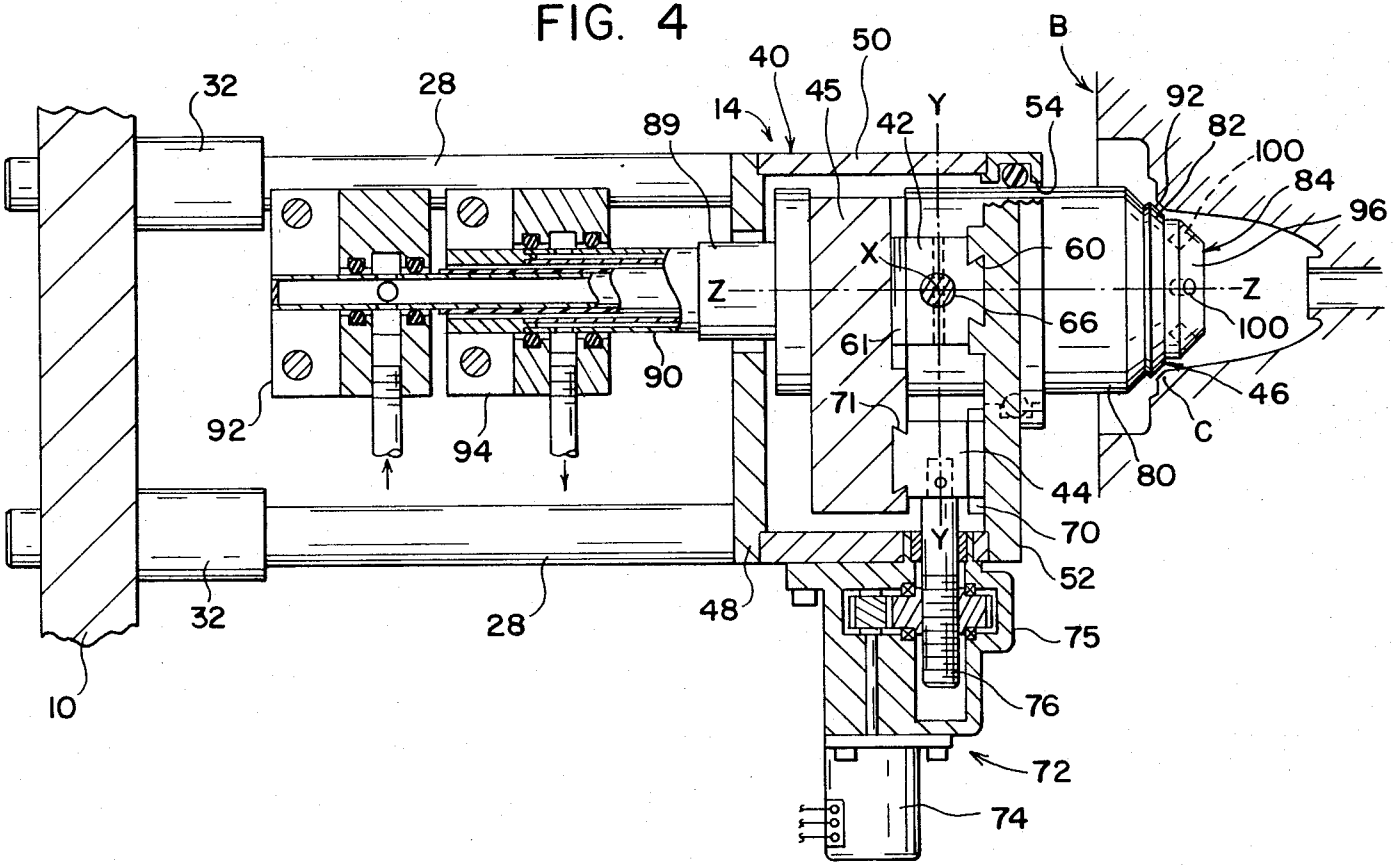
FIG. 4 is an enlarged sectional view taken along line 4—4 of FIG. 3 showing the inductor in the heating position.

Referring to FIGS. 3 and 4, the inductor assembly 14 comprises a generally rectangular housing 40, an X-axis positioning block 42, a Y-axis positioning block 44 to which a radially floating plate 45 is engaged. An inductor head 46 is mounted on the plate 45.

The housing 40 includes a base plate 48, an outer sleeve 50 and a front plate 52 having a central opening 54. The drive shaft 26 and the guide rods 28 and 30 are fixedly connected to the rear surface of the base plate 48. The base plate 48, the sleeve 50 and the front plate 52 are fixedly assembled by suitable fasteners 55 and define, in assembled relation, a cavity retaining the blocks 42 and 44 and the plate 45 with the inductor head 46 projecting outwardly thereof through the opening 54. While generally rectangular, in overall configuration, the functional aspects may be retained in other envelopes, cylindrical or the like.

Referring to FIGS. 3 and 5, the block 42 is slidably supported on the inner surface of the plate 52. Movement of the block 42 with respect to the plate 52 and the shaft 26 is constrained to bidirectional movement along the X-axis by means of cooperating slot and key 60. Relative movement with respect to the plate 45 is accommodated by cooperating key and slot 61. Movement of the block 42 along the X-axis is effected by X-axis drive assembly 62 including an electric motor 64 and actuator 65 having a threaded output shaft 66 connected to the block 42. Upon bidirectional rotation of the motor 64, the movement of the shaft 66 is effective to move the block 42 and the inductor head 46 selectively along the X-axis.

Referring to FIGS. 4 and 5, the Y-axis positioning block 44 is slidably retained between the front surface of the front plate 52 and the plate 45. Movement of the block 44 is constrained to bidirectional movement along a Y-axis mutually perpendicular to the Z-axis and X-axis by cooperating key and slot 70. Relative movement with respect to the plate 45 is accommodated by cooperating key and slot 71. Movement of the positioning block 44 along the Y-axis is effected by Y-axis drive assembly 72 including drive motor 74 and an actuator 75 having a threaded output shaft 76 connected to the block 44. Upon bidirectional rotation of the motor 74, the actuator 75 drives the output head 46 along the Y-axis.

Accordingly, upon selected energization of the motors 64 and 74, the head 46 will be infinitely, variably positionable in the X-Y radial plane with respect to the axis of the shaft 26 and the axis of the valve seat C.

The inductor head 46 comprises an annular carrier 80 carrying an inductor coil 82 and a positioning detector assembly 84 mounted at the outer end thereof. The carrier 80 is formed from suitable nonconductive material. The carrier 80 is fixedly connected to the front surface of the plate 45. The detector assembly 84 is also formed of a nonconductive material that is adhesively or mechanically secured to the carrier 80. The inductor coil 82 has a generally square cross section with a hollow interior through which coolant flows during the heating cycle. The coil 82 is fixedly retained in a circumferential groove between the assembly 84 and the carrier 80. The coil 82 has output leads 86 and 88 extending along the carrier 80 which pass through the interior of a hub portion 89 retained in the plate 45 to sleeve assembly 90 and are connected to electrical and coolant assemblies 92 and 94 in a conventional manner as set forth in greater detail in U.S. Pat. No. Re. 29,046. The inductor coil has a conical outer surface 92 complementary in shape and size with the valve seat C.

Figure 7:
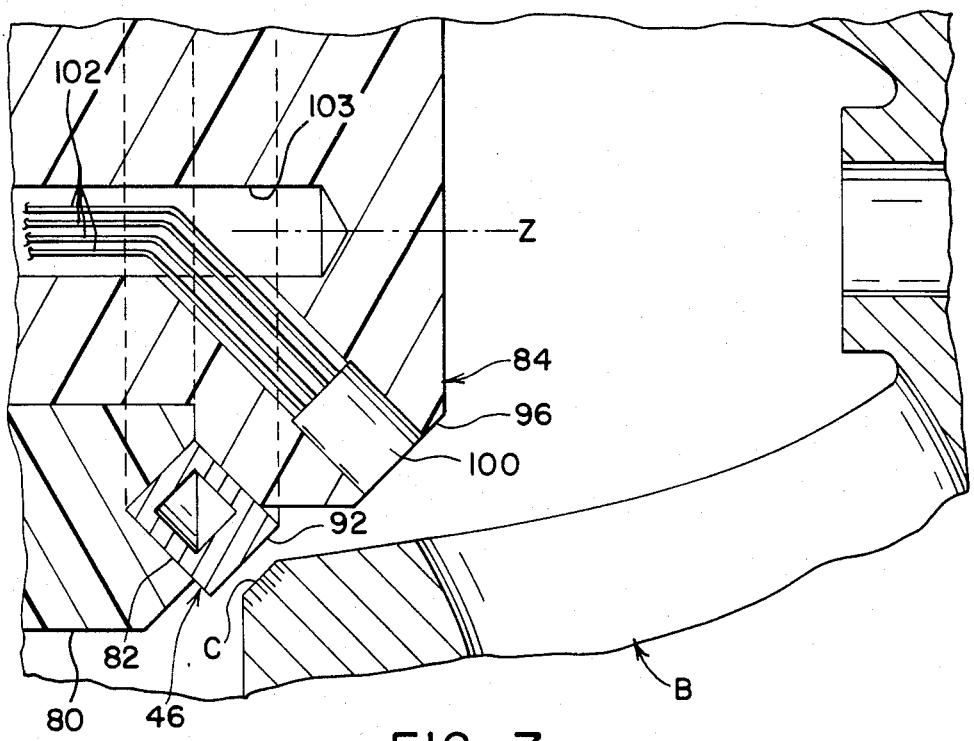
FIG. 7 is an enlarged section taken along line 7—7 of FIG. 6.

Referring to FIGS. 6 and 7, the detector assembly 84 has a generally frustoconical surface 96 also complementary to the valve seat C. Four equally, circumferentially spaced recesses are formed in the frustoconical surface 96 perpendicular thereto and thus mutually perpendicular to the valve seat surface. Two of the recesses are located in a plane mutually perpendicular to the X and Z axes. The other two recesses are formed in a plane mutually perpendicular to the Y and Z axes. Range detector transceiver units 100 are mounted in the recesses. The range detector transceiver units 100 have leads 102 passing through opening 103 in the inductor head 46 and extending outwardly of the assembly 40 along the cylindrical sleeve 90. The leads 102 are electrically connected to control systems, not shown, as hereinafter described.

The transceiver unit 100 may be any suitable and conventional energy transmitting and receiving unit using laser, infrared, ultrasonic or like devices wherein transmitting section emits energy toward a reflecting surface and a receive section receives the reflected energy from the reflecting surface and transmits a signal in accordance therewith. In the preferred embodiment, pairs of such units are effective for establishing X-axis and Y-axis positioning, and all four units are effective for establishing Z-axis positioning. However, it will be appreciated that alternative arrangements can be provided whereby the transceiver units are displayed in different arrays and cooperate in greater or lesser numbers to provide affirmative positioning of the inductor assembly about one or more of the positioning axes.

More particularly, after the inductor assemblies 14 have been driven by the motor 16 along the Z-axis to the rough position shown in FIG. 2*b*, the transceiver units 100 are energized and the individual signals from the receiver sections are fed into a comparator or microprocessor. The comparator is programmed to transmit a signal to the control unit of the X-axis motor 64 and the Y-axis motor 74 based on a comparison of the signals from the individual units. For instance, if the inductor head 46 deviates from the Z-axis in the X direction, the comparator will transmit a signal of requisite polarity to energize the X-axis motor 64 in the appropriate direction for moving the head 46 toward the Z-axis. The signal will continue until the head is properly positioned at which time a signal balance will be achieved thereby terminating the drive signal to the X-axis motor control unit. In a similar fashion, the comparator will feed a signal to the Y-axis control unit of appropriate polarity to energize the Y-axis motor 74 until the signals received from the transceiver units positioned on the Y-axis are balanced whereby proper Y-axis positioning is indicated and the motor control function terminated. Concurrently with the X-axis and Y-axis positioning, or subsequently thereto, the comparator determines the level of the signals from all four transceiver units and compares this to a predetermined reference signal. The reference signal is experimentally correlated to the spacial location of the transceiver units with respect to a reference diameter on the valve seat. When this predetermined reference signal has been detected, the comparator transmits a further signal to the control unit of the Z-axis motor 22 continuing movement along the Z-axis for an experimentally determined additional distance, equal to the axial spacing between the transceiver units and a reference diameter on the inductor surface which distance of movement will position the inductor coil 92 at the predetermined optimum magnetic coupling gap therebetween.

Figure 8:
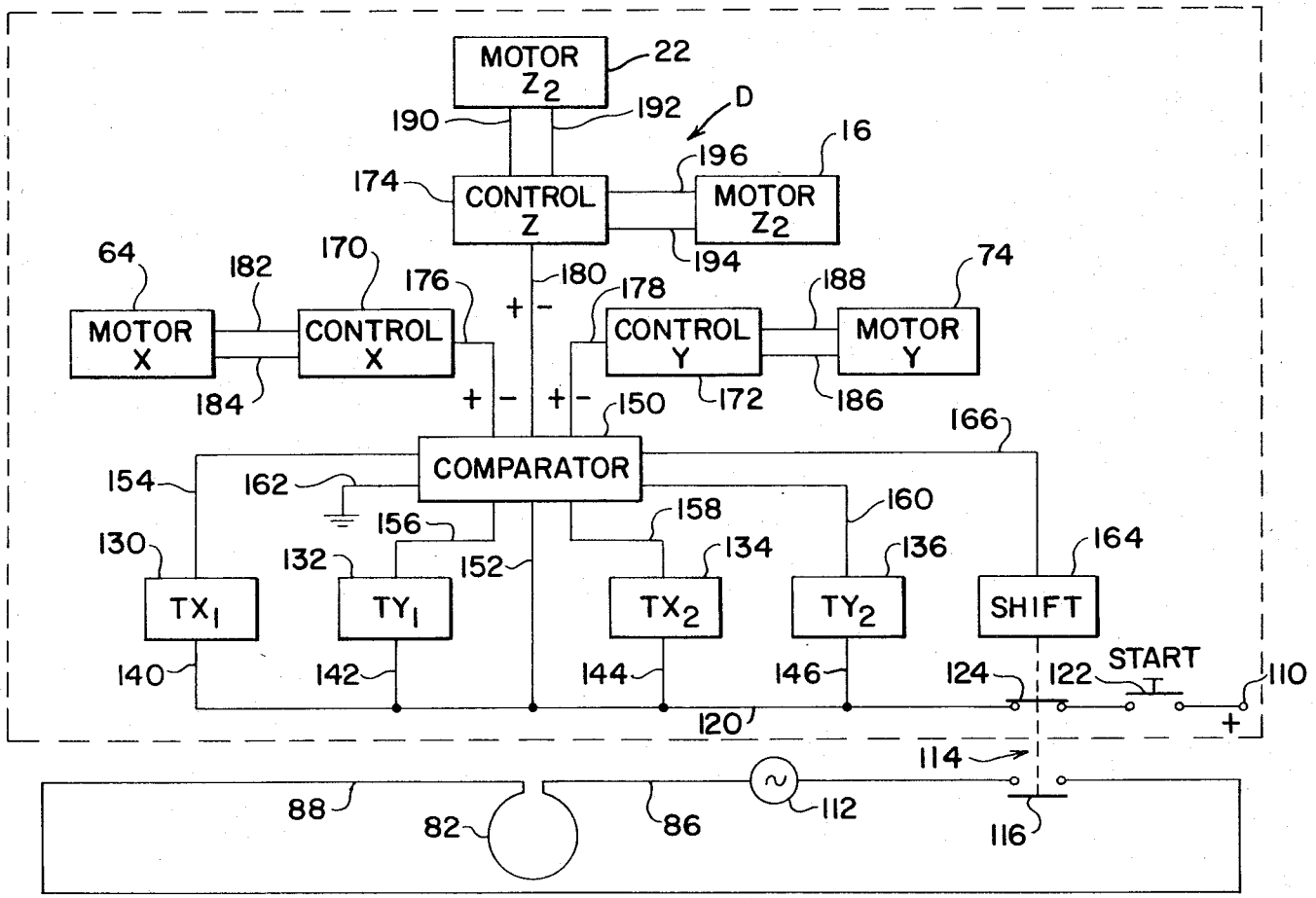
FIG. 8 is a schematic control diagram for the operation of the inductor positioning assembly.

Referring now to FIG. 8, there is shown a control system D for providing the aforementioned automatic positioning of the inductor head 46 with respect to the valve seat so as to establish a preselected gap therebetween and provide the optimum magnetic coupling for the inductive heating. The control system is described with respect to a separate power supply for the inductors 82 and the inductor assemblies 14. However, it will be appreciated that a common power supply can be used and that the inductor assemblies can be sequenced through a common comparator. Additionally, the individual inductor may be in a common circuit. These and other variations for providing the inductor coil positioning are compatible with achieving the overall functional control as illustrated in the preferred embodiment of FIG. 8.

Therein, the control system D is coupled to a suitable power source through line 110. The inductor coil 82 has a first lead 86 electrically connected to one side of a conventional high frequency power supply 112 and a second lead 88 electrically connected to the other side of the power supply 112 through a shift relay 114. The shift relay 114 includes normally open contacts 116. When the contacts 116 are closed, the power supply 112 is operative in a conventional manner to energize the inductor coil for inductively heating the associated valve seat C.

The control system D is supplied with power through the line 110 to line 120 through a normally open starting relay 122 and normally closed contacts 124 coupled to the shift relay 114. Transceiver units 130, 132, 134 and 136 are connected to line 120 through lines 140, 142, 144 and 146 respectively. The units 130 and 132 correspond to units located on the X-axis described above. The units 134 and 136 correspond to units located on the Y-axis. A comparator 150 is connected to line 120 by line 152. The output signals from the units 130, 132, 134 and 136 are fed to the comparator 150 through lines 154, 156, 158 and 160, respectively. The comparator 150 is connected to ground 162. The comparator 150 is connected to a shift control 164 through line 166. The shift control 164 is mechanically coupled to the contacts 116 and 124 of the shift relay 114. The contacts 116 and 124 are thus movable in phase opposition between open and closed positions under the control of the shift control 164.

Servo control units 170, 172 and 174 are connected to the comparator 150 through lines 176, 178 and 180 respectively. The unit 170 is connected to the X-axis drive motor 64 through lines 182 and 184. The unit 172 is connected to the Y-axis drive motor 74 through lines 186 and 188. The unit 174 is connected to the Z-axis drive motor 22 through lines 190 and 192, and to the rough drive motor 16 by lines 194 and 196.

The comparator 150 receives signals from the transceiver units and as described above provides signals of appropriate polarity to selectively energize the control units for achieving positioning through the associated drive motor until the predetermined positioning of the inductor coil 82 with respect to the valve seat C is achieved. The comparator 150 is also effective to advance the frame 10 between the zero and rough positions shown in FIGS. *2a* and *2b* and to return the frame 10 and the inductor assemblies 14 to the loading or zero positions after completion of the inductive heating cycle.

In operation, the starting relay 122 is depressed thereby energizing the comparator 150 through lines 120 and 152. The comparator 150 transmits a signal to the control unit 174 to energize the motor 16 to advance the frame 10 from the zero position shown in FIG. *2a* to the rough position shown in FIG. *2b*. Concurrently, the units 130, 132, 134 and 136 are energized by a line 120 through lines 140, 142, 144 and 146 respectively, and commence transmitting energy to the valve seat surface and receive the reflected energy from the valve seat surface. The receiver sections of the units 130, 132, 134 and 136 transmit signals to the comparator 150 through lines 154, 156, 158 and 160. The comparator 150 compares the levels of the signals from the X-axis transceiver units 154 and 158. If an imbalance is determined, a signal of requisite polarity is transmitted through line 176 to the control unit 170. The control unit 170 is operative to transmit currents of the requisite polarity through lines 182 and 184 to energize the X-axis motor 64 in the proper rotational mode to thereby move the inductor head 46 in the desired direction toward X-axis alignment. When a signal level balance is received by the comparator 150 from the transceivers 130 and 134, the control signal to the control unit 170 is terminated.

Concurrently with an X-axis positioning, the receiver sections of the Y-axis transceivers 132 and 134 transmit signals to the comparator 150 through lines 156 and 158. The comparator, upon sensing an imbalance in the signal levels, transmits a signal of requisite polarity through line 178 to the control unit 172. The control unit 172 is then effective to energize the motor 74 through lines 186 and 188 in a proper rotational mode to thereby move the inductor head 46 along the Y-axis until alignment is achieved at which point a signal balance is achieved and the control signal to the control unit 174 is terminated.

Concurrently with the X-axis and Y-axis positioning, the comparator 150 feeds a signal through line 180 to control unit 174. The control unit 174 energizes the motor 22 through lines 190 and 192 in a rotational mode effective to move the inductor head 46 along the Z-axis toward the valve seat C. During this movement toward the valve seat, the level of the signals is compared to a predetermined signal level. This predetermined signal level corresponds to a signal level experimentally determined when the transceiver units are at a predetermined position with respect to the valve seat. This is also referenced to axial position of the inductor coil 82 at the predetermined optimum magnetic coupling between the inductor surface 92 and the valve seat C. When the signal level corresponds to such predetermined value, the comparator 150 is operative to maintain energization of the Z-axis drive motor 22 through the control unit 174 until a gap establishing the predetermined magnetic coupling is attained between the inductor coil 82 and the valve seat C. When this predetermined gap is attained, the comparator 150 transmits a signal through line 166 to energize the shift control 164 to shift the relay 114 to open contacts 124 and to close contacts 116. The closing of contacts 116 connects the inductor coil 82 to the power supply 112 and initiates the heating cycle. The inductor circuit remains energized for predetermined time sufficient to raise the valve seat temperature to the desired heat treating temperature prior to quenching. Upon reaching the desired heat treating temperature as determined by control systems, not shown, the quenching cycle is initiated and the shift control 164 is energized, thereby opening contacts 116 to terminate the heating cycle and closing contacts 124. The comparator 150 then feeds a signal opposite polarity through line 180 to control unit 174 which is effective to energize the Z-axis drive motor 22 in a reverse rotational mode to return the inductor 14 to the rough alignment position shown in FIG. *2b*. Thereafter, control unit 174 is effective to deenergize the motor 22 and to energize the rough positioning motor 16 through lines 194 and 196 for returning frame 10 to the zero or loading position shown in FIG. *2a*. At the zero position, the starting relay 122 is opened to deenergize the control system D until the next positioning and heating cycle is required.

In the above described embodiment, the X and Y-axis positioning is attained through affirmative signals to control the associated drive motors. This achieves automatic coaxial positioning of the inductor coil with respect to the valve seat. However, it should be appreciated that the inductor may be mechanically positioned in this concentric alignment by various means. For instance, the floating head assembly disclosed in the previously mentioned U.S. Pat. No. Re. 29,046 could be used for achieving the coaxial positioning of the inductor coil. Other float or non-floating mechanical positioning arrangements can also be used. Further, the Z-axis positioning of the inductors could be achieved after all conductors have been physically seated against the valve seat with the required gap established as inductor coil is moved away from the valve seat. Thus, the function of the transceiver units could be limited to transmitting signals indicative of a predetermined spacial relationship between the transceivers, the inductor and the valve seat. Such arrangements could also reduce the number of transceiver units required to achieve the desired axial positioning of the inductor.

Moreover, it is apparent that a single comparator may be sequenced to individually align the various inductor assemblies. With these various modifications, however, the basic automatic axial positioning through range detection would be provided.

Still further, the positioning assembly described above can also be advantageously used to accurately locate other heating devices such as plasma torches, gas torches, oxyacetylene torches and electric heaters for applications requiring precisely located orientation between the heating device and the surface to be heated.

Having thus described my invention, I claim:

1. An induction heating device for heating the conical surface of a valve seat of an engine component prior to quench hardening, said induction heating device comprising:

inductor means having a conical surface complementary to the conical surface of the valve seat;

means for advancing said inductor means toward said valve seat;

guide means for accommodating movement of the inductor means in a plane wherein the axes of the conical surfaces are parallel;

means coacting between said guide means, the valve seat, and said inductor means for coaxially positioning said conical surfaces;

means for detecting the distance between said inductor means and the valve seat subsequent to the coaxial positioning and during said advancing toward said valve seat, said detecting means including transceiver means reflectively coacting with the conical surface of the valve seat and transmitting a signal related to the distance between said inductor means and said valve seat;

means for receiving said signal and operable for further continuing said advancing of said inductor means toward said valve seat until said conical surfaces are coaxially aligned at a predetermined spaced relationship;

means for energizing said inductor means at said predetermined spaced relationship; and, means operative after said heating for retracting said inductor coil away from the component.

2. Induction heating device as recited in claim 1 wherein said transceiver means are carried on said inductor means in advance of said conical surface thereof and are operative for transmitting energy for reflection off of said conical surface and for receiving the reflected energy, said transceiver means transmitting a signal indicative of the position of said transceiver means relative to said conical surface of the induction means and the conical surface of the valve seat, and comparator means for comparing the instantaneous position of the transceiver means with instantaneous position of the inductor means and said predetermined distance for continuing said advancing of said inductor means toward said valve seat until said conical surfaces are at said predetermined spaced relationship.

3. The induction heating device as recited in claim 2 wherein said transceiver means comprise a laser transceiver device.

4. The induction heating device as recited in claim 2 wherein said transceiver means comprises an ultrasonic transceiver device.

5. The induction heating device as recited in claim 2 wherein said transceiver means comprises an infrared transceiver device.

6. A method for inductively heating the conical surface of a valve seat of an engine component prior to heat treating, comprising the steps of:

providing an inductor coil having a conical surface complementary to the valve seat;

advancing the inductor coil toward the valve seat;

coaxially aligning the conical surfaces during said advancing of said inductor coil toward said valve seat;

reflecting energy off said conical surface of the valve seat during said advancing;

detecting the reflected energy during said advancing;

comparing the detected energy to a predetermined energy level;

maintaining said advancing toward said valve seat until said predetermined energy level is attained;

further continuing said advancing of said inductor coil toward said valve seat in accordance with said detected energy until said inductor coil is coaxially positioned at a predetermined spacing between said conical surfaces;

energizing said inductor coil to inductively heat the conical surface of the valve seat and, retracting said inductor coil following said energizing.

7. The method as recited in claim 6 comprising the further step of limiting movement of the inductor coil to a plane perpendicular to the axis of the conical surfaces.

8. The method as recited in claim 7 comprising the further steps of maintaining said advancing until said predetermined energy level is attained, comparing the predetermined energy level to the instantaneous position of the inductor coil, and continuing the advancing of the inductor coil toward the valve seat from the instantaneous position in accordance with the comparing until the coil is coaxially positioned at said predetermined spacing.

9. An induction heating apparatus for heating conical valve seat surfaces of an engine component, said apparatus comprising:

frame means supported for movement toward and away from the engine component;

a plurality of inductor assemblies carried on said frame means for independent movement with respect thereto;

first means for advancing said frame means and said inductor means toward said engine component from an initial position to a roughly aligned position;

each inductor assembly including an inductor coil having a conical surface complementary to the conical valve seats on the engine component;

second advancing means associated with each inductor assembly for independently advancing the inductor coil relative to said frame means and toward said valve seat;

guide means associated with each inductor assembly for accommodating movement of said inductor coil in a plane wherein the axes of the conical surfaces are parallel;

aligning means associated with each of said inductor assemblies coacting between said guide means, the valve seat and said inductor coil for coaxially positioning said conical surface of said inductor coil with respect to said conical valve seat;

detecting means operatively associated with each inductor assembly for independently determining the distance between said inductor coil and the valve seat during operation of said second advancing means, said detecting means including transceiver means reflectively coacting with a conical surface of the valve seat and transmitting a signal related to the distance between said inductor coil and the valve seat;

means associated with said inductor assemblies for receiving said signal from said transceiver means and operable for independently continuing the advancing of each of said inductor coils toward the associated valve seat until each inductor coil is coaxially aligned with the valve seat at a predetermined spaced relationship;

means operative when each of said inductor coils is at said predetermined spaced relationship for energizing said coils to inductively heat the associated valve seat to a predetermined elevated temperature; and, means for retracting each of said plurality of inductor assemblies with respect to said frame means and said frame means together with said inductor assemblies relative to the inductively heated component to said initial position.

* * * * *